United States Patent [19]

Sumitani et al.

[11] Patent Number: 4,511,138

[45] Date of Patent: Apr. 16, 1985

[54] GAME CALCULATING APPARATUS

[75] Inventors: Toshihiko Sumitani, Nara; Kenichiro Komeda, Gose, both of Japan

[73] Assignee: Sharp Kabushiki Kaisha, Osaka, Japan

[21] Appl. No.: 407,482

[22] Filed: Aug. 12, 1982

[30] Foreign Application Priority Data

Aug. 18, 1981 [JP] Japan ..... 56-129866
Aug. 26, 1981 [JP] Japan ..... 56-134440

[51] Int. Cl.[3] ..... A63B 71/06

[52] U.S. Cl. ..... 273/1 E; 273/138 A; 273/1 GC

[58] Field of Search ..... 273/1 E, 1 GC, 85 G, 273/138 A, 143 R, DIG. 28

[56] References Cited

U.S. PATENT DOCUMENTS 3,770,269 11/1973 Elder ..... 273/138 A
3,902,725 9/1975 Massicotte ..... 273/143 R
4,095,795 6/1978 Saxton et al. ..... 273/143 R

*Primary Examiner*—Richard C. Pinkham
*Assistant Examiner*—MaryAnn Stoll Lastova
*Attorney, Agent, or Firm*—Birch, Stewart, Kolasch & Birch

[57] ABSTRACT

A game calculating apparatus includes a key unit consisting of a plurality of keys, a plurality of the display positions, and a complete game function processor operatively coupled to a random access memory and read only memory. A first symbol is variably displayed in each of said display positions either randomly or at specific cycle intervals during the game mode. To stop the movement of each said desired symbol a selected specific key must be actuated. The processor then determines the degree of exact matching of the signal representing the stopped first symbols and another signal representing a second set of symbols previously stored in the memory.

3 Claims, 11 Drawing Figures

E — L — 5 — 1

— — —

5 3 — 0 8 — 2 6

GAME CALCULATING APPARATUS

BACKGROUND OF THE INVENTION

The present invention relates to a game calculating apparatus that enables the user to enjoy games using a keyboard and display devices contained therein.

A number of new games utilizing microcomputers have recently been developed and applied to a variety of video games, game machines and educational aids with the trend being to incorporate these devices into calculators and watches.

OBJECT AND SUMMARY OF THE INVENTION

In keeping with this trend, the present invention provides a new game calculating apparatus embodying a variety of new ideas.

More particularly, the present invention relates to a game calculating apparatus enabling the user to enjoy a variety of games, for example, a so-called throttle machine game that cyclically displays specific numbers and/or characters in plural displays at random positions and also that calculates and displays the pattern that is present in the memory when "stop" key is pressed by the user and the total score is calculated from the game's time factor.

The primary purpose of the present invention is to provide a game calculating apparatus that not only enables the user to play a variety of games, but one that also measures either the user's reaction speed or his daily physical condition and reflex nerve as determined by the user's score.

Other objects and further scope of application of the present invention will become clear from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention presents a game calculating apparatus characteristically comprising a multisymbol display device that is capable of cyclically displaying a specific number of numerals and/or characters from random positions, a keyboard unit that allows the user to stop the action and display the contents of each position in the display, and a means that calculates and displays both the still display pattern symbols and the player's score, which is calculated from the game's time factor. Another embodiment of the present invention includes a game calculating apparatus that comprises a multikey keyboard, a symbol display device, a game function that displays the first variable symbol during the game mode either at random or at specific intervals, and a means of identifying the coincidence of a signal that displays said first symbol during still and the other signal that displays the second symbol which is being stored—or will be stored—in the memory, and then displaying a specific symbol on the display device in response to the result identified.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE INVENTION

The game calculating apparatus embodied in the present invention characteristically comprises a number of features that can help promote the use and sale of electronic calculators.

Confidential information which should not be known by any third party can be stored in the game calculating apparatus which is accessible only by the person who enters said information. In addition, the game calculating apparatus automatically identifies the degree of the coincidence achieved by the user so that a plurality of users can compete for the highest score.

One particular embodiment of the game calculating apparatus related to the present invention is described below.

When the "start" key on the keyboard of the game calculating apparatus is pressed, either a number from 0 through 9 or one of the characters A, E, F, and L, will appear as the first symbol in all other positions in the eight-position display at random. Numbers and characters appearing in each display position respectively line up, and thus the display of any number or character starts from any random position in order to enable the display device to repeatedly display any number from 0 through 9 or any character, A, E, F, or L at random in each of the display positions, I, II, III, and IV.

EXAMPLE

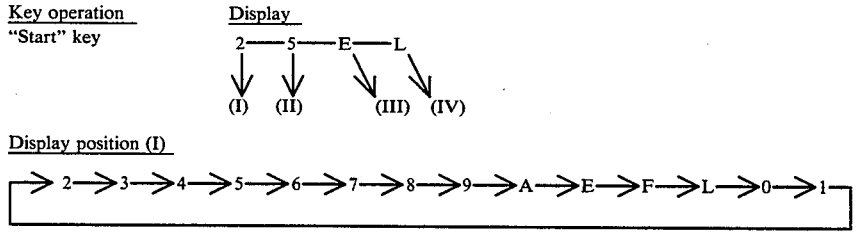

-continued

Display position (II)

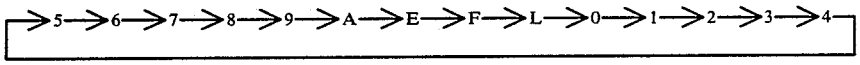

Display position (III)

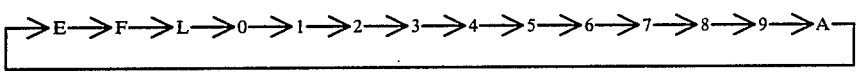

Display position (IV)

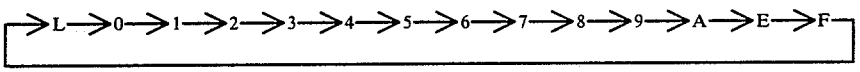

As soon as said "start" key is pressed, the contents (the first symbol) in the display devices then start to vary, then these contents in said display positions (I) through (IV) will be stopped by a signal key on the keyboard, for example, position I is controlled by the "0" key, position II by the "." key, position III by the "=" key, and position IV by the "+" key. Thus, when any of these keys is pressed, the cyclical movement of the display contents in the display position corresponding to that key will stop.

Assume that the data corresponding to the second symbol stored in the Ram memory is E-L-5-1. If the corresponding key is pressed and the randomly varying contents of the display device exactly match the E-L-5-1 data, then specific symbols or words can be output in the display. This can effectively be applied to the output of a word, for example, such as "Happy", on the game display device. Then, the purchaser may be entitled to receive any memorial prize from either the retail shop or manufacturer upon presentation of the customer card, enabling them to eventually promote sales. Such an exciting idea can be embodied by the game calculating aparatus as one application thereof. If the user wishes to protect a piece of confidential information, he can store it in the device's ROM memory. Information stored in this manner can be read out only by the person who entered it.

The first embodiment of the present invention will be described in detail below, with reference to the accompanying drawings.

Figure 1:
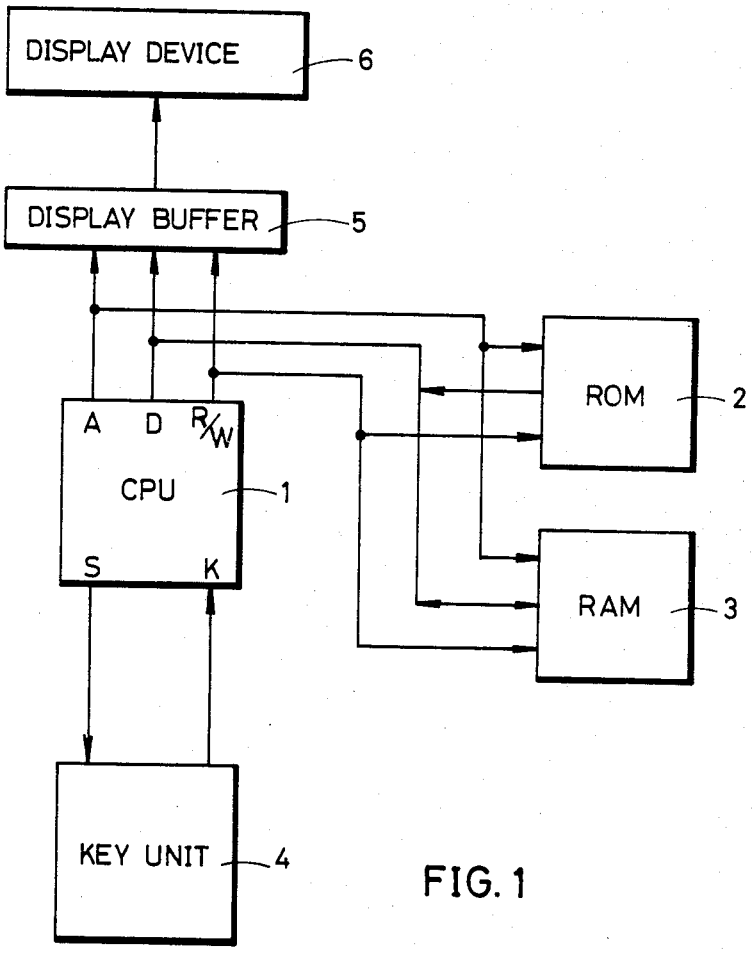
FIG. 1 shows a systematic block diagram of the first embodiment related to and embodied by the present invention.

FIG. 1 shows a systematic block diagram of the game calculating apparatus, where 1 represents the central processing unit (CPU), 2 represents the read-only memory (ROM), 3 represents the random access memory (RAM) that writes and reads the key operation signals in and out of memory, 4 represents the multiple-key keyboard unit, 5 represents the display buffer, and 6 represents the multiple-position display device.

The CPU 1 either reads the key operation signal within itself in a manner predetermined by the ROM 2, or it displays the contents of the RAM 3 by means of the display device 6.

ROM 2 contains the program for either reading and displaying the key operation signals, or performing calculations using the values and formulas written in the RAM 3.

RAM 3 is a random access memory that memorizes values and/or formulas.

Either a flat or counter for controlling a variety of conditions used for the signal processing in the CPU 1 is provided in the RAM 3 memory.

Symbol 4 represents the key unit that contains a matrix circuit where the strobe signal (S) out from the CPU 1 is being matrixed with the key operation signal (K).

Display buffer 5 outputs the display data written by the CPU 1 after being converted into an optimum signal for the display device.

Figure 2:
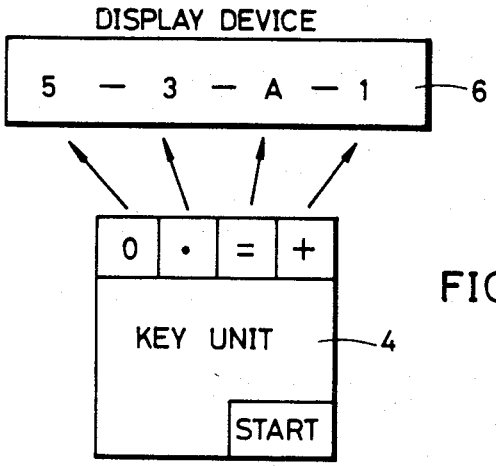
FIG. 2 shows a typical embodiment of the display device during the game mode, and a partial block diagram of the relevant keys on the keyboard.

FIG. 2 shows an illustration of a typical display device 6 and a part of the game operations keys on the keyboard. This particular display device 6 displays four random figures or characters and said display contents are cyclically and optionally displayed by the CPU 1 either at random or under a specific order.

Normally, every key on the keyboard is used to execute calculations, however, in the game mode, certain keys are used to stop the movement of the variable display contents either at random or under a specific cycle.

For example, pressing "0" numeric key displays the contents of the uppermost position of the display device 6, pressing the decimal point "." key displays the contents of the second position, pressing the equal "=" key displays the contents of the third position, and pressing the addition "+" key displays the contents of the bottom low position, respectively. Thus, the operator can operate these keys so that the contents (the first symbol) being displayed at random by the display device 6 can be stopped when the contents match the signals corresponding to the other display contents (the second symbol) that have been previously stored or are newly stored in the memory by means of key operations.

In other words, the relationship of the keys shown in FIG. 2 to the display positions in the display device exactly match the sequential order of the display positions are shown by the arrows.

Figure 3:
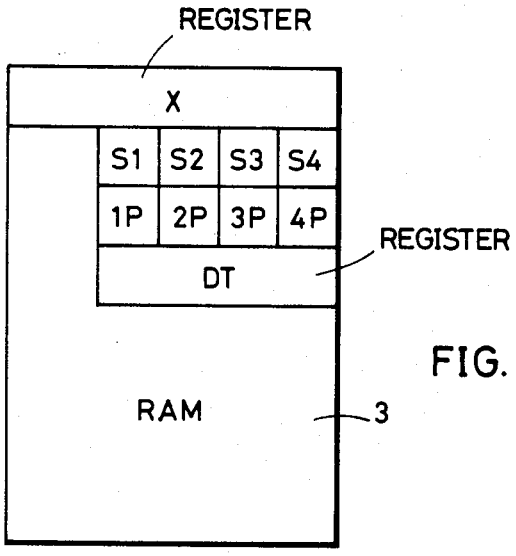
FIG. 3 shows a partial block diagram of the Ram 3 device incorporated in the game of calculating apparatus shown in FIG. 1.

FIG. 3 shows a part of the RAM 3 shown in FIG. 1, where registers X and DT, flags S1 and S4, and flags 1P through 4P respectively function as shown below.

X: This register memorizes the display contents such as the result of a calculation.

DT: This register memorizes the data that determines the cycles by which the display contents are varied during the game mode.

S1 through S4: When the display contents in each position are brought to a stop by pressing the appropriate keys (FIG. 2), flags S1 through S4 are respectively activated in response to each position in the display device.

1P through 4P; When the display contents in each display position are stopped from their varied movements during the game mode, if any of the display contents matches the memory data, flag 1P through 4P will be activated as shown below.

For example, these flags will be activated in the following situations.

1P will be set when the display contents in two display positions match.

2P will be set when there are two pairs of matching display contents.

3P will be set when the display contents in three positions match.

4P will be set when the numerical values in all four positions match.

The operational performance of the game calculating apparatus embodied by the present invention is described below in reference to the flow chart shown in FIG. 4.

Step ① performs the initial activation of a game. Random digits for the four display positions are first generated by register X of the RAM 3 so that the initial display contents can be determined. At the same time, flags are the reset.

Step ② performs the time counting simultaneously with the game activation and determines whether the predetermined game duration time (the DT register in the RAM 3) has been exceeded or not. If it has been exceeded, step ② automatically terminates the game.

If the game duration time has not been exceeded, step ③ through step ⑥ determine whether any of the game keys (for example, the "0", ".", "=", and "+" keys) has been activated or not, where these keys respectively function to stop variable movements of the display contents in each display position, as shown in FIG. 2.

When any of the four display stop keys is pressed after step ③ through ⑥ perform identification, steps ⑦ through ⑩ then set flags S1 through S4 which correspond to the four positions in the display device.

If there is any display position that has already stopped when any of the remaining display stop keys are operated, step ⑪ then determines whether the display data in that position matches the data contents stored in the ROM memory. Step ⑪ also determines whether the display contents already stopped in this position exactly match the display contents in the just stopped position, and if they match, step ⑪ activates flags 1P through 4P.

Step ⑫ determines whether all of the variable movements of the four display contents have been stopped, i.e., whether flags S1 through S4 are all activated or not, and if they are, the game is terminated.

If one of the flags have been activated, step ⑬ is activated, which then counts up the register DT that determines the timing in order to vary the display contents.

Step ⑭ determines whether register DT has exceeded the count limit or not, and also determines a specific cycle for varying the display contents. If register DT has already exceeded the count limit, step ⑭ will vary the display contents. Then, prior to the ensuing variation process, step ⑮ varies the display contents in those display positions where the data variation has not yet been stopped, i.e., step ⑮ varies the display contents that still remain in any position to which flag S1 through S4 have not been applied yet. This variation process is performed by register X. After step ⑫ determines that the game has been terminated, step ⑰ determines whether there is any coincidence in the display contents between these display positions, i.e., whether any of flags 1P through 4P have been activated.

Step ⑯ displays the contents stored in register X and varies the display contents of the game being played.

After step ⑫ determines that the game is terminated, step ⑰ then detects whether there is any coincidence in the display contents between the display positions used, i.e., step ⑰ determines whether flags 1P through 4P are activated or not. When flags 1P through 4P are activated, step ⑱ makes the display positions repeatedly flash at intervals of two flashes in every one-half second, informing the operator that the display contents have exactly matched each other.

Figure 5A:
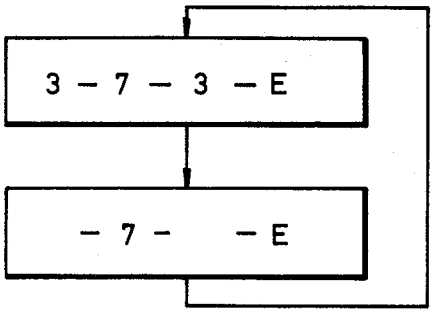
FIGS. 5 (A) through (D) show concrete displays of the flashing numbers and characters in the symbols upon complete coincidence.
Figure 5:
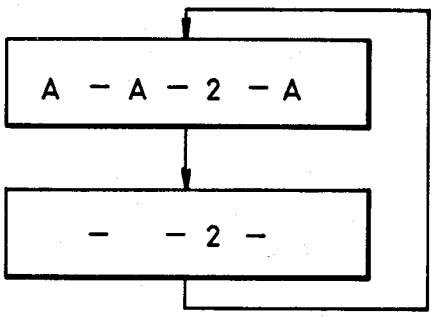
Figure 5:
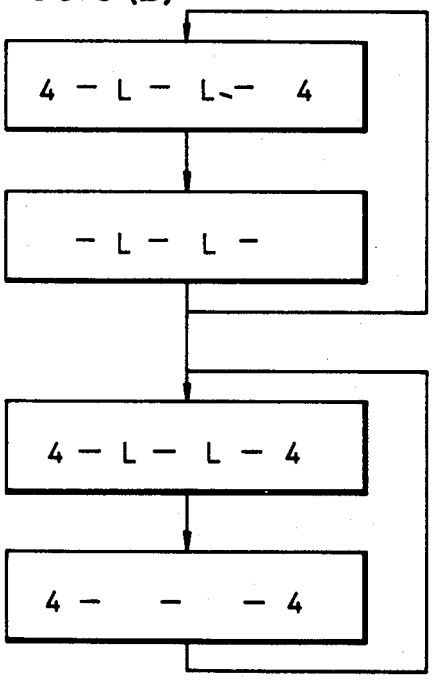
Figure 5:
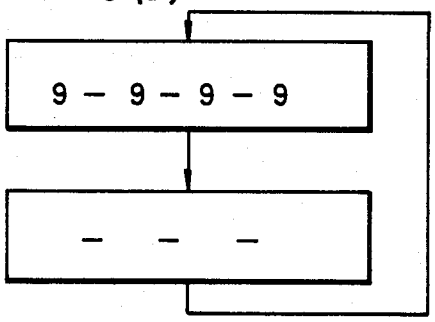

A typical example when the flashing is performed by the matching display positions is shown in FIGS. 5 (A) through 5 (D).

In FIG. 5 (A), two display positions ("3" and "3") match, where numerals in two positions repeat flashing. In FIG. 5 (B), two pairs of two display positions match, where one pair of two display positions precedes the other pair of two display position in the flashing operation. In FIG. 5 (C), three display positions match each other, while all of four display positions are in complete coincidence in FIG. 5 (D).

As soon as step ⑱ has completed the process, step ⑲ automatically calculates the scores. If none of the display contents had matched during the step ⑰ procedures, step ⑳ stops the display contents to vary in each display position, while it simultaneously determines whether the display contents and the sequence of the four display positions have matched the specific display contents (pattern) stored in the CPU. If both of the display contents match, as was done by step ⑱, step ⑳ then displays the score, and then all the display positions remain flashing as with the case of FIG. 5 (D), until the next key operation is performed.

When the four display positions remain flashing with each of the display contents matching the specific display contents (pattern) set by the CPU, step 22 determines whether the specific keys that can stop the display contents in each display position have been activated or not. If these keys are already activated, step 23 then sets a certain display data (called confidential data) in register X, which cannot be accessible under the normal operations. Step ㉔ displays the contents of register X. As with steps ⑱ and ⑲, steps ㉑ through ㉓ automatically set confidential informations in register X after the flashing operations are completed. During this stage, key identification step ㉒ will not operate at all.

Figures 6E, 6F, 6G:
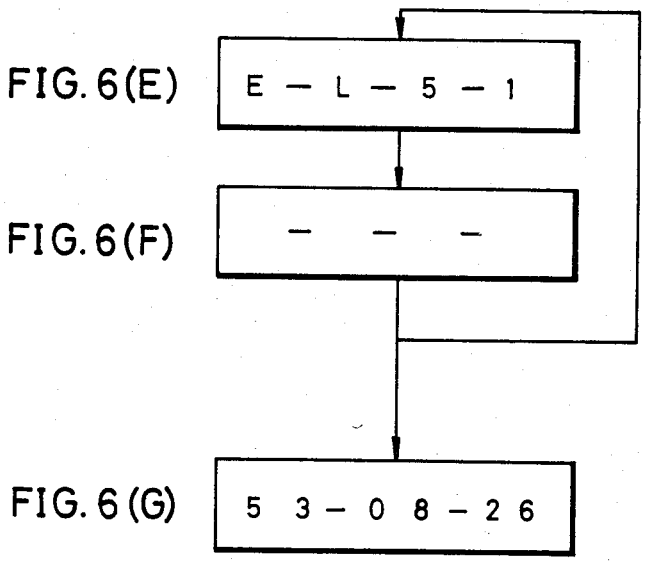
FIGS. 6 (E) through (G) show typical displays of the kinds of confidential information that can be stored in the device by the user.

FIGS. 6 (E) and (F) illustrate typical examples of confidential data, where randomly variable display data are in the still mode in the four display positions. When the display contents (the first symbol) have just matched the specific pattern (the second symbol) of the display contents memorized by the CPU, all the display contents shown in FIGS. 6 (D) and (E) start to flash repeatedly. Simultaneously, if a specific key is operated, a certain confidential information (a specific symbol) will be displayed as shown in FIG. 6 (G). Such a confidential information cannot be available under any other condition or operation.

Figure 4:
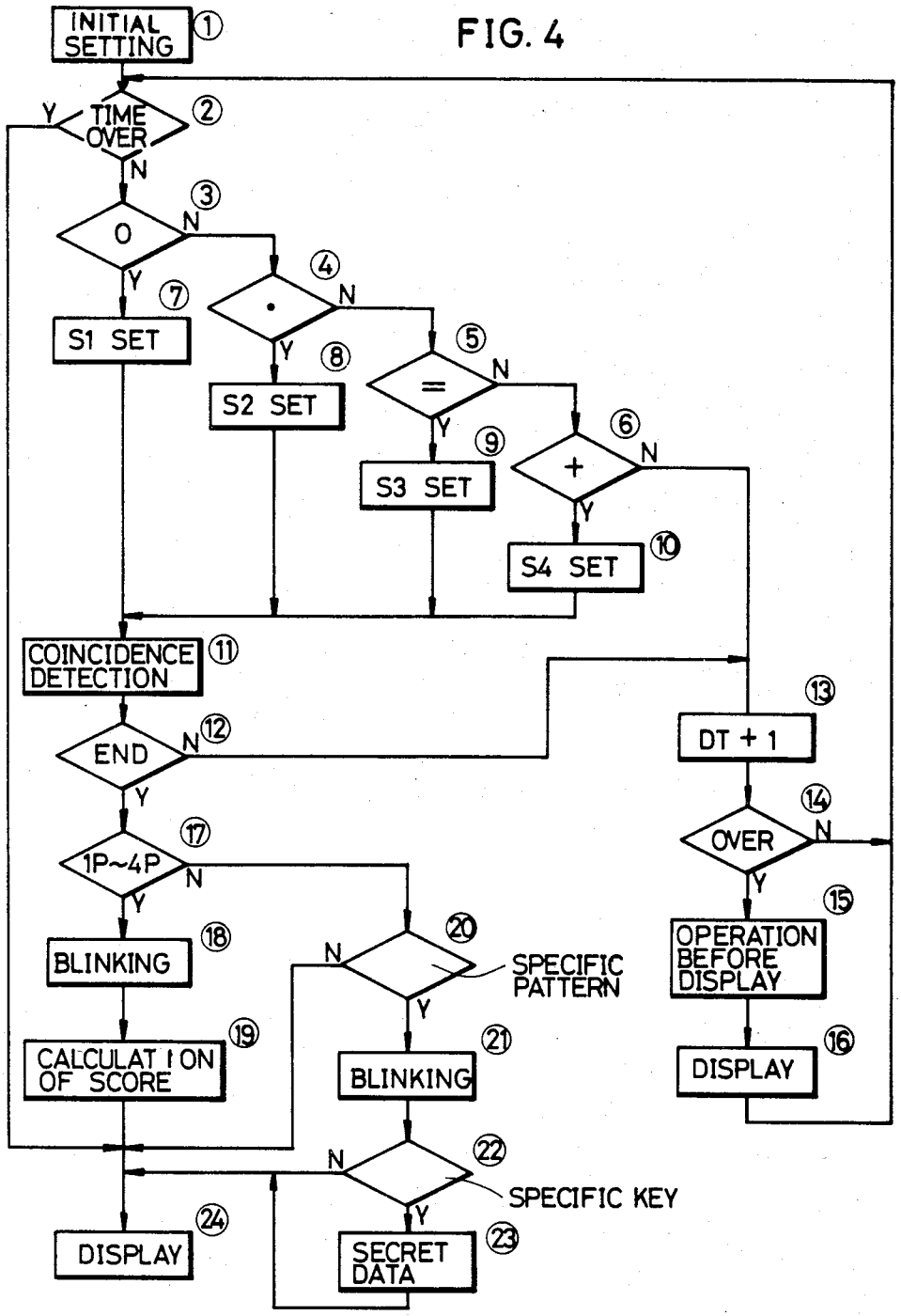
FIG. 4 shows a flow chart describing the operation of the Ram 3 device shown in FIG. 3.

In FIG. 4, a variety of scores out from step ⑨ operation can be calculated by the following formula;

$$A \times B \times C + D \times T$$

where A represents the score obtained from the number of display positions matched. If all of the four display positions exactly match, a total of 20 will be scored. If three display positions match, a total of 15 will be scored. If two pairs of two display positions exactly match, a total of 5 will be scored. If two display positions match, a total of 2 will be scored, whereas the score will be zero if all the display contents in the four display positions do not match at all.

In the above formula, B represents scores achieved in response to the contents of the display positions matched. If the matching contents represent any of the numerals from 0 through 9, the score will be 8, and if the display contents represent any character other than said numerals, the score will be 10.

In the above formula, C and D represent the constant. T represents the game's time factor which is the time remains after a time spent to stop the contents of the four display positions is deducted from the predetermined game duration time.

As described above, the game calculating apparatus embodied in the present invention is particularly useful due to a variety of unsurpassed advantages, wherein the display device in the game calculating apparatus which comprises plural display positions displaying numerals and/or characters that are variable either randomly or at a specific cycle, displays specific symbols by stopping the contents of plural display positions as of a specific pattern and enables the user to store any confidential data in said game calculating apparatus, that can be accessible only by the person who entered it.

Furthermore, the game calculating apparatus embodied in the present invention displays specific numerals and/or characters in plural display positions from any random position at any specific cycle. On the other hand, said game calculating apparatus calculates and displays the total scores in responding to the displayed pattern and game's time factor as soon as the cyclically varying display contents have been optionally stopped by operating the stop key.

As a result, users can enjoy any game such as a throttle machine game using the game calculating apparatus. In addition, users can measure their reaction speed or daily physican conditions and reflex nerve in relation to their scores achieved.

The present invention thus described will potentially lead the game calculating apparatus to diversified variations, Such variations, however, should not be construed to be a departure from the original spirit and scope of the present invention, therefore all such potential modifications shall also be included within the scope of the following claims.

What is claimed is:

1. A game device for use as a secondary function in an electronic device having a diverse primary function, comprising:

display means for displaying a plurality of characters at a plurality of display positions;

means operatively connected to said display means for sequentially varying the characters displayed at each said display position;

key means operatively connected to said means for varying for selectively stopping said variation of said characters at all said display positions upon actuation thereof;

memory means for storing a reference pattern of characters representative of a possible display therein;

means responsive to actuation of said key means comparing a first signal representative of the patterns displayed on said display means with a second signal representative of said reference pattern stored in said memory means and producing a unique indicia upon determination of a coincidence therebetween wherein said indicia is a code word symbolizing a specific prize to be awarded; and wherein said unique indicia is separate from score; and wherein said unique indicia is only outputted on the display, as opposed to being outputted as a hard copy; and wherein said secondary function includes outputting said code word, and said primary function includes operation of said electronic device for purposes other than displaying said code word.

2. The device of claim 1 wherein said characters varied by said means for varying are randomly generated.

3. The device of claim 1 wherein said reference pattern of characters is randomly generated of alphanumeric characters.

* * * * *